US009309684B2

(12) United States Patent
Richards et al.

(10) Patent No.: US 9,309,684 B2
(45) Date of Patent: Apr. 12, 2016

(54) EASY DOME COVER

(76) Inventors: Jack Eugene Richards, Henderson, KY (US); Janie Marie Richards, Henderson, KY (US)

( * ) Notice: Subject to any disclaimer, the term of this patent is extended or adjusted under 35 U.S.C. 154(b) by 0 days.

(21) Appl. No.: 12/928,782

(22) Filed: Dec. 20, 2010

(65) Prior Publication Data

US 2013/0139312 A1 Jun. 6, 2013

Related U.S. Application Data

(60) Provisional application No. 61/335,980, filed on Jan. 15, 2010.

(51) Int. Cl.
*E04H 4/00* (2006.01)
*E04H 4/10* (2006.01)

(52) U.S. Cl.
CPC ..... *E04H 4/10* (2013.01); *E04H 4/103* (2013.01); *E04H 4/106* (2013.01)

(58) Field of Classification Search
CPC ..... E04H 4/10; E04H 4/106
USPC ..... 4/498, 499, 503
See application file for complete search history.

(56) References Cited

U.S. PATENT DOCUMENTS

| | | | | |
|---|---|---|---|---|
| 3,184,764 | A * | 5/1965 | West | 4/498 |
| 3,523,308 | A * | 8/1970 | Bradley | 4/503 |
| 3,533,110 | A * | 10/1970 | Gisondi | 4/499 |
| 4,537,147 | A * | 8/1985 | Nivin | 4/503 |
| 4,847,925 | A * | 7/1989 | Perry | 4/499 |
| 6,286,157 | B1 * | 9/2001 | Baumann | 4/503 |
| 7,871,052 | B2 * | 1/2011 | Baum | 248/505 |

* cited by examiner

*Primary Examiner* — Tuan N Nguyen
(74) *Attorney, Agent, or Firm* — Gary K. Price

(57) ABSTRACT

A pool cover having a main cover sized and shaped larger than the swimming pool size. The main cover includes an outer edge having a pocket. The pocket includes an interior, ends with openings to access the interior, a plurality of slits in communication with the interior, a plurality of drain openings, and strap members for securing the pool cover to a surface. The interior of said pocket is sized for receiving a weight. The pool cover can include an air pillow for placement between the surface of the water in the pool and the main cover. The pocket allows for a uniform weight to be placed around the outer edge of the main cover in order to pull the main cover tight enough over the air pillow resulting in a dome like effect over the swimming pool.

9 Claims, 2 Drawing Sheets

EASY DOME COVER

CROSS REFERENCES TO RELATED APPLICATIONS

U.S. Provisional Application for Patent No. 61/335,980, filed Jan. 15, 2010, with title "Easy Dome Cover" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

The present invention relates in general to covers for water-filled outdoor swimming pools, and more particularly, a cover for above ground pools.

2. Brief Description of Prior Art

It has long been common practice to use pool covers to reduce the amount of leaves and debris entering the pool when the pool is not in use, such pool covers typically being in the form of a tarpaulin stretched over the pool or floating on the surface of the water. Another purpose of the pool cover is to assist in preventing persons, particularly unattended children or animals venturing onto the pool cover, from falling through the cover into the underlying water.

Problems are generally presented by the use of prior art pool covers; one problem being the accumulation of debris and water causing water pooling on the pool cover which presents drowning hazards, particularly to small children. One attempted resolution to water pooling on the pool cover is the use of drain filters that allow the water to drain directly into the pool through a filtered drain opening in the pool cover. The larger the openings through the pool cover, however, the greater is the loss of strength of the cover. Accordingly, additional strengthening means must then be provided which adds to the cost and complexity of the cover. Further, with drain filters, debris can also fall through the openings and into the underlying pool.

The present invention addresses the foregoing described problems of the prior art.

SUMMARY OF THE INVENTION

A swimming pool cover for covering the underlying water in an above ground swimming pool. The pool cover includes a main cover sized and shaped for covering the surface of the water in the swimming pool and, the main cover is sized larger than the pool size. The main cover includes an outer edge that defines a sleeve or pocket that extends the length of the outer edge. The pocket includes an interior, ends with openings to access the interior, a plurality of slits in communication with the interior, a plurality of drain openings spaced along the length of the pocket, and strap members spaced along the length of the pocket for securing the pool cover to a surface. The interior of said pocket is sized for receiving a weight such as a single water tube or a double water tube that is disposed in a horizontal position in the interior.

The swimming pool cover can further include an air pillow, such as an inflatable air pillow, for placement in the center of the swimming pool and sandwiched between the surface of the water in the swimming pool and the main cover in order to create a dome like effect over the surface of the water in the swimming pool. The pocket extending along the main cover's outer edge allows for a uniform weight to be placed around the outer edge in order to pull the main cover tight enough over the air pillow resulting in the dome like effect over the swimming pool.

DESCRIPTION OF THE PREFERRED EMBODIMENT

Figure 1:
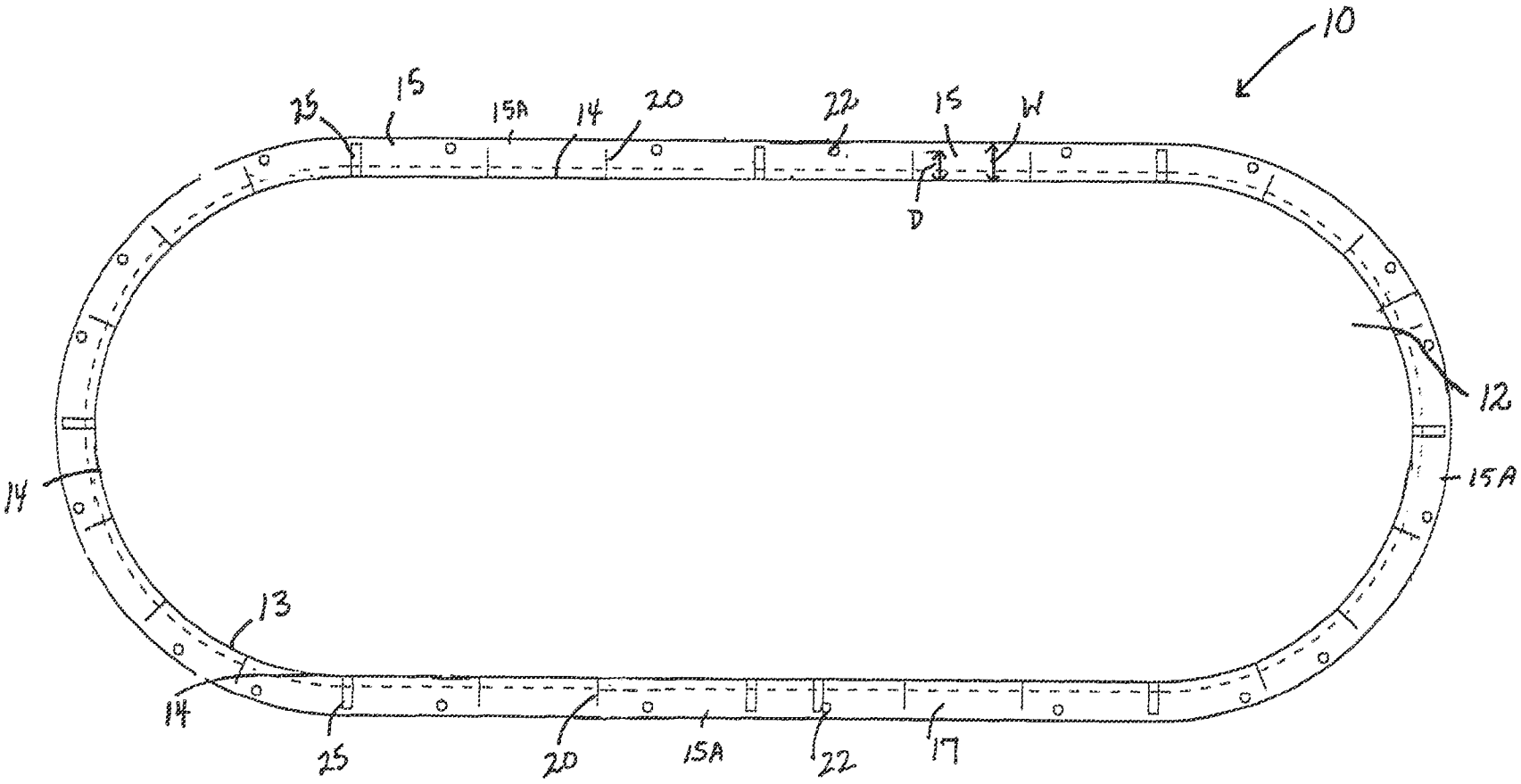
FIG. 1 is a top plan of the present invention, an Easy Dome Cover.

The apparatus of the present invention is directed to a pool cover useful for above ground swimming pools. FIG. 1 shows a pool cover 10 intended, in known fashion, to be draped over an above ground swimming pool (not shown).

The portion of the illustrated pool cover includes a main cover sheet 12 of known type which completely covers the underlying water and is impervious to water. In the preferred embodiment, the cover sheet 12 is made two feet larger all the way around the actual pool size. It should be understood, the size of the pool cover 10 varies depending upon the size of the swimming pool. However, in the preferred embodiment, the cover sheet 12 is made two feet larger all the way around than the actual pool size whether it be round or rectangle.

As illustrated, the pool cover 10 further includes a pocket portion 15 attached 14 to an outer edge 13 of the main cover sheet 12. In the preferred embodiment, the pocket portion 15 has a width W of approximately 14 inches to 18 inches. The pocket portion 15 defines a closed bottom portion 15A for holding a signal or double water tube (not shown) that is disposed in a horizontal position in an interior portion 16 (see FIG. 2) of the pocket portion 15.

Figure 2:
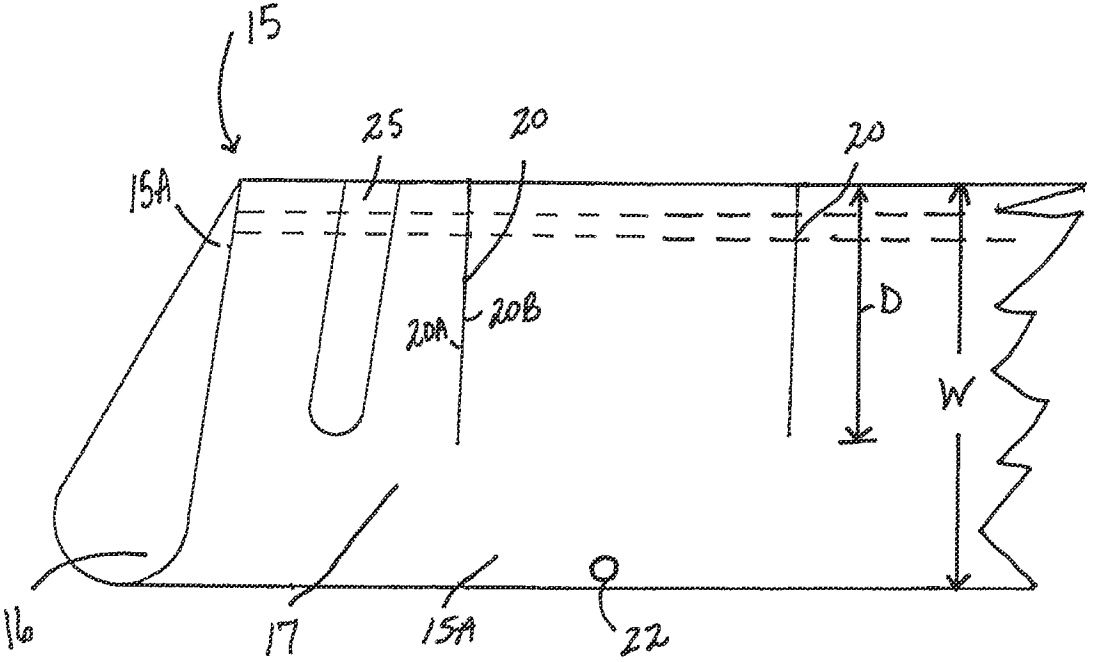
FIG. 2 is an enlarged sectional view of the pocket portion of the Easy Dome Cover in FIG. 1.

The pocket portion 15 further includes a plurality of slits 20 in order to access the interior portion 16 of the pocket portion 15. In the preferred embodiment, each slit 20 is positioned every three or four feet along the length of the pocket portion 15 and each slit 20 is approximately eight to ten inches in length. Further, an as disclosed, each slit 20 is preferably vertically disposed on an outer surface 17 of the pocket portion 15, and has a distance D that is less that the pocket's width W (best seen in FIG. 2). Each of the plurality of slits 20 do not extend to the pocket's closed bottom portion 15A. The plurality of slits 20 include sides 20A, 20B (see FIG. 2) and have an open position where the sides are separated for access to the interior 16, and a closed position, as shown in FIG. 2, where the side 20A is in contact with side 20B.

The pocket portion 15 further defines a plurality of openings 22 spaced along the length of the pocket portion 15 for draining any water that enters the interior 16 of the pocket portion 15. In the preferred embodiment, the opening 22 has a diameter of three-quarter inches.

As illustrated, the pocket portion 15 is attached 14 to the outer edge 13 of the cover sheet 12. In the preferred embodiment, the means of attachment 14 is stitching.

Secure straps 25 are attached to the pocket portion 15 and are spaced evenly around the cover 10 for securing the cover 10 to a stake (not shown) in the ground surface. Conveniently, the secure straps 25 are designed to keep the cover 10 from sliding one way or the other due to differing weights of the water tubes or from strong winds. The secure straps 25 extend from the pocket portion 15 and provide means for rigidly securing the pool cover 10 to securing means, e.g. stakes in the ground.

The pool cover 10 can further include an inflatable air pillow (not shown), having either a round or rectangular configuration, that is placed in the center of the swimming pool. The air pillow includes a grommet (not shown) in each corner such that the air pillow can be tied to the pool, for example, in order to keep the air pillow centered while placing the main cover sheet 12 over the air pillow. The air pillow is inflated to a height of approximately three to four feet in the center portion of the pillow.

In application, the air pillow is placed in the center of the swimming pool as previously discussed, and the main cover sheet 12 is then pulled over the air pillow and the water tubes are placed evenly in the pocket portion 15. The weight of the water tubes pulling down the cover sheet 12 over the inflated pillow creates a dome like effect over the swimming pool. As a result, this dome like structure prevents water, snow or debris like leaves and tree branches from sitting on top of the pool cover 10 or entering the pool. It also provides a safety feature by not allowing an open area where anyone or any animal can gain access to the pool.

As should be understood, the pocket portion 15 allows for a uniform weight to be placed around the outer edge 13 of the main cover sheet 12 in order to pull the main cover sheet 12 tight enough over the inflatable pillow that results in a dome over the pool.

Although the description above contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims and their legal equivalence, rather than by the examples given.

We claim:

1. A protective swimming pool cover comprising:

a main cover sized and shaped for covering the surface of the water in the swimming pool and wherein said main cover is larger than the pool size;

said main cover having an outer edge and a pocket defining a width and having an upper most top end attached to said outer edge, wherein said pocket comprising:

an interior, a closed bottom portion, a plurality of slits in communication with said interior, said slits spaced along the length of said pocket, and wherein each of said slits vertically extend downward from said upper most top end a distance that is less than said width, and wherein each of said plurality of slits are not in communication with said closed bottom portion, a plurality of drain openings, each of said plurality of drain openings spaced between said slits and disposed at a bottom most end of said pocket, said bottom most end opposite said top end, strap members attached to said upper most end and spaced between said drain openings for securing the pool cover to a surface; and wherein said interior of said pocket is sized for receiving a weight.

2. The protective swimming pool cover as recited in claim 1, wherein said pocket extends the entire length of said outer edge.

3. The protective swimming pool cover as recited in claim 2, wherein each of said slits have an open position where a first side and a second side of each slit are separated, and a closed position where said first side is in communication with said second side.

4. The protective swimming pool cover as recited in claim 2, wherein said pocket is attached to said outer edge with stitching.

5. The protective swimming pool cover as recited in claim 1, wherein each of said plurality of slits is positioned every 3 or 4 feet along the length of said pocket.

6. The protective swimming pool cover as recited claim 5, wherein each of said plurality of slits is approximately 8" to 10" in length.

7. The protective swimming pool cover as recited in claim 6, wherein each of said plurality of slits is vertically disposed on an outer surface of said pocket.

8. A protective swimming pool cover comprising:

a main cover for covering the surface of the water in the swimming pool, and having an outer edge that defines a sleeve that extends along said outer edge, wherein said sleeve having a width, and a closed bottom end, and further including a plurality of slits that downwardly extend from a top end of said sleeve, said plurality of slits in communication with said sleeve's interior, and wherein each of said plurality of slits having a distance, said distance is less than said width, a plurality of drain apertures spaced along the length of said sleeve, each of said drain apertures disposed between said slits at a lower most portion of said sleeve, straps spaced along the length of said sleeve and disposed between said drain apertures, and wherein said closed bottom end is sized for receiving a weight.

9. The protective swimming pool cover as recited in claim 8, wherein each of said plurality of slits is vertically disposed on an outer surface of said sleeve.

* * * * *